United States Patent [19]

Sell

[11] Patent Number: 4,663,848

[45] Date of Patent: May 12, 1987

[54] BALL-HANDLED SCISSORS

[76] Inventor: Anthony Sell, 1220 Greenridge, Algonquin, Ill. 60102

[21] Appl. No.: 756,164

[22] Filed: Jul. 18, 1985

[51] Int. Cl.[4] ..... B26B 13/00

[52] U.S. Cl. ..... 30/261; 30/254; 30/194; 30/212; D8/57

[58] Field of Search ..... 30/261, 234, 341, 254, 30/256, 194, 120, 211, 212; D8/57

[56] References Cited

U.S. PATENT DOCUMENTS

| | | | |
|---|---|---|---|
| 73,580 | 1/1868 | Cook . | |
| 123,371 | 2/1872 | Turner . | |
| 576,688 | 2/1897 | Perry | 30/261 |
| 664,613 | 12/1900 | Badger | 30/261 |
| 770,347 | 9/1904 | Brown | 30/261 X |
| 987,095 | 3/1911 | Bonta . | |
| 2,637,939 | 5/1953 | Polk | 46/124 |
| 2,640,264 | 6/1953 | Sullivan et al. | 30/254 X |
| 2,846,811 | 8/1958 | Polk | 46/124 |
| 3,186,126 | 6/1965 | Ostrander | 46/118 |

*Primary Examiner*—E. R. Kazenske

*Assistant Examiner*—W. Fridie

*Attorney, Agent, or Firm*—McCaleb, Lucas & Brugman

[57] ABSTRACT

Scissors have a pair of pivotally interconnections blades and a ball-shaped handle. One embodiment has a pair transversely spaced, outwardly-convex, partly ball-shaped handle members at the rear end portions of the blades and an elastomeric member compressibly interposed between the handle members biasing the blades toward an open position. The handle members and elastomeric member have complementary, partly ball shapes providing an overall external configuration of a single ball. Another embodiment has a hollow, flexible ball completely covering and enclosing partially ball shaped handle members, the pivotal interconnections between the blades is concealed within the ball shaped covering, and a formed wire spring member is anchored at the interconnections and its opposite ends are seated against inner surfaces of the handle members. In each embodiment, manual squeezing pressure applied by a user's palm or fingers closes the blades against the bias of the elastomeric or wire spring member.

8 Claims, 12 Drawing Figures

48
34
36
30
20
28
44
42
52
26
40
39
46
32
38
56
54
50
24
7

BALL-HANDLED SCISSORS

BACKGROUND OF THE INVENTION

Typically, scissors have finger- and thumb-engaging loops at the handle end portion. In small scissors, for button holes, embroidery and manicuring, these loops are generally the same size and shape. In larger scissors, one of the loops has an elongated oval shape to receive two or more fingers and the other is a relatively shorter oval for the thumb. For a comfortable fit, in most scissors, the fore and aft inner surfaces of the thumb loop are inclined forwardly at about 45° and the comparable inner surfaces of the finger loops are inclined rearwardly at about the same angle to accommodate a natural, most comfortable 90° angular relationship of the thumb with respect to the fingers in use.

This angular relationhip made for one hand is uncomfortable for the other. For this reason, medium- and large-size scissors are marketed in right- and left-hand models.

This has disadvantages for many people. A left handed person cannot comfortably use right-handed scissors and vice versa. Further, a person whose hands and fingers are crippled or stiffened by arthritis, for example, or who has lost a thumb or one or more fingers, these can be most difficult to use.

For the above reasons, a substantial number of people find it awkward, inconvenient or impossible to use scissors which have thumb- and finger-receiving loops.

Accordingly, there is considerable room for improvement in scissors handles.

SUMMARY OF THE INVENTION

It is a general object of the present invention to provide scissors which are equally convenient for use by right- or left-handed people and by people whose fingers are stiff or who have missing digits.

A primary object of the invention is to provide ball-handled scissors comprising a pair of pivotally interconnected blades, and a ball-shaped handle which can be squeezed by a user's palm or fingers of either hand for actuating the blades.

Another object is to provide scissors having a pair of pivotally interconnected blades with outwardly-convex, partialy ball-shaped, manually movable members, and an elastic member compressibly interposed between the manually mobile members to bias the blades toward an open position enabling the blades to be actuated by squeezing pressure.

Another object is to provide such scissors in which partly ball-shaped members and an elastic member compressibly interposed between them have complementary partly ball shapes to provide the general external configuration of a single, squeezable ball.

Another object of the invention is to completely cover and enclose outwardly convex, partly ball-shaped handle members with a hollow, flexible ball to present the external configuration of a single manually compressible ball which is squeezable to close the blades.

Another object is to conceal the blade pivot connection within a hollow flexible ball handle.

Another object is to bias the pivotally interconnected blades toward an open position by a formed wire spring anchored to the pivotal interconnection, seated against opposite inner surfaces of the handle members, and completely concealed within a hollow flexible ball.

BRIEF DESCRIPTION OF THE DRAWINGS

Other objects and advantages will be apparent from the following description taken in connection with the drawings in which.

Like parts are designated by like reference numerals throughout the figures of the drawing.

DETAILED DESCRIPTION OF THE PREFERRED EMBODIMENTS

Figure 10:
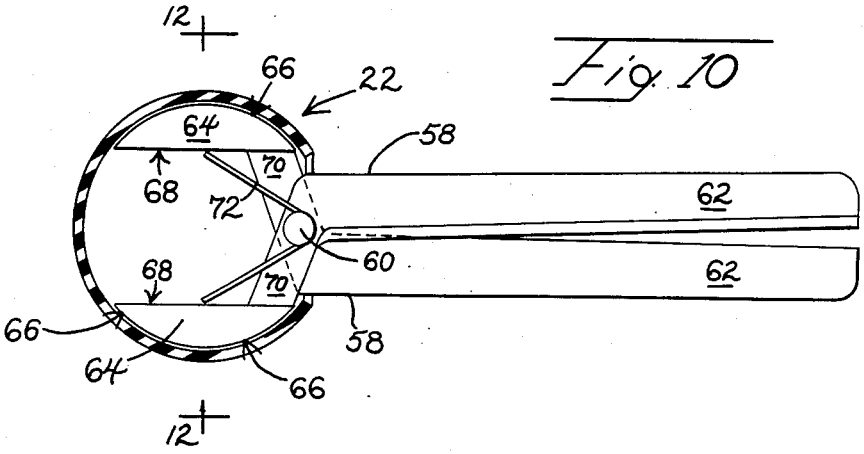
FIG. 10 is a side view similar to FIG. 1 but partly in cross-section of another embodiment of the invention.
Figure 11:
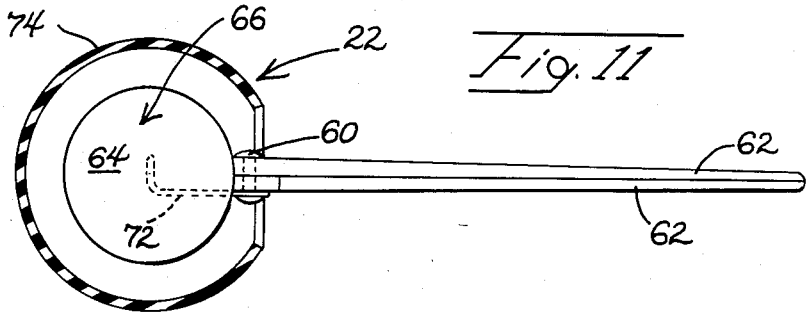
FIG. 11 is a top plan view of FIG. 10 partly in section.
Figure 12:
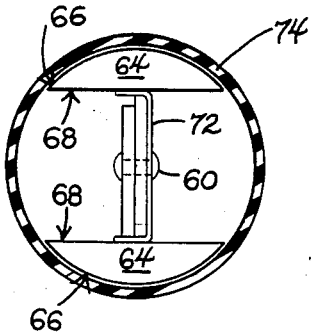
FIG. 12 is a vertical cross section of FIG. 10 taken on line 12—12.

Referring now to the invention shown in the drawings, the embodiment illustrated in FIGS. 1–9 is generally designated 20 and the embodiment shown in FIGS. 10–12 is generally designated 22.

Figures 1, 2, 3, 4, 5, 6, 7, 8, 9:
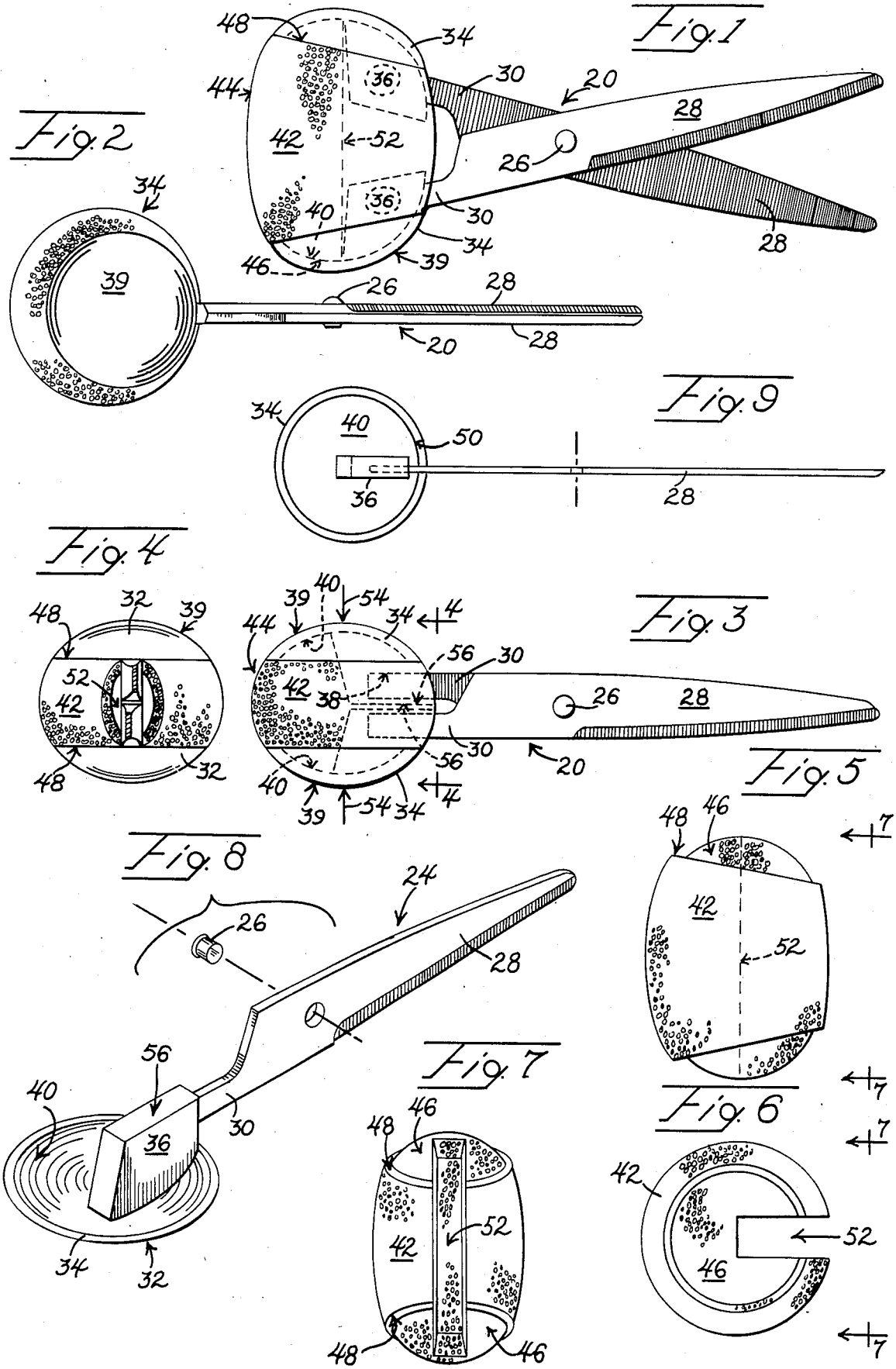
FIG. 1 is a side view of a pair of scissors showing a preferred form of the present invention in open position.
FIG. 2 is a top view of FIG. 1.
FIG. 3 is a side view similar to FIG. 1 showing the scissors in closed position.
FIG. 4 is a vertical partly sectioned view of FIG. 3 taken on line 4—4.
FIG. 5 is a side view of a compressible elastomeric member shown in FIG. 1.
FIG. 6 is a top view of FIG. 5.
FIG. 7 is a front view of the elastomeric member shown in FIGS. 5 or 6 as seen in the direction of arrows 7—7.
FIG. 8 is a perspective view of one of the substantially identical blade and handle halves of the scissors.
FIG. 9 is a top plan view of one of the scissors halves shown in FIG. 8.

Scissors embodiment 20 comprises a pair of identical halves 24 one of which is shown in FIG. 8. These are pivotally interconnected in the usual manner, for example, by a pivot pin 26, or a pivot screw (not shown). Each blade has a forward cutting end portion 28 and a rear end portion 30. A handle portion 32 connected to the rear end portion of each blade includes a ball-shaped handle member 34 and a stop member 36 which is connected to the corresponding blade rear end portion 30.

The handle portion 32 will preferably be molded of plastic material and it may be connected to the rear end portion of the blade either by molding it directly thereon or by fitting it into a recess 38 (FIG. 3) and holding it by means of a suitable adhesive. Alternatively, the entire half 24 may be formed of metal.

The handle member 34 is concavo-convex in shape, having an outwardly convex, partly ball-shaped surface 39 which is manually engagable and an inner concave surface 40.

An elastomeric member made of foam rubber on rubberlike material is assembled in the space 44 between the handle portions 32. It has a pair of convex opposite end surfaces 46 and a pair of diagonal annular surfaces 48. These are seated respectively against the inner concave surfaces 40 and annular surfaces 50 respectively in each handle member 34. They may be permanently adhered in place.

Thus, the outer surfaces of the partly ball-shaped handle members 34, and the partly ball-shaped elastomeric member 42 are complementary providing the general external configuration of a single ball which is deformable by manual squeezing between the fully open position of FIG. 1 and the fully closed position of FIG. 3.

A forward slot 52 in the elastic member 42 provides a recess for the stop member blocks 36 as best shown in FIGS. 1 and 4.

The elastic member 42 biases the blades to an open position as shown in FIG. 1 Inward squeezing pressure exerted by a user's palm or fingers of either hand in the direction of the arrows 54, 54 in FIG. 3 move the blades to the closed position of FIG. 3 where closing movement is limited by abutment between the stop block inner surfaces 56, 56 as best shown in FIGS. 3 and 8.

Referring now to the embodiment 22 shown in FIGS. 10–12, it comprises a pair of identical blades halves 58, 58 pivotally interconnected by a pin 60. Each has a forward end portion 62 with a cutting edge, a ball-shaped handle member 64 with an outer convex surface 66 and an inner surface 68, and an offset portion 70 connecting a handle member to the respective forward cutting edge portion. A formed wire spring 72 is anchored at the pivot pin 60 and has opposite end portions seated against the inner handle surfaces 68 to bias the blades toward a closed position.

A hollow, flexible, rubberlike ball $\theta$ completely covers and encloses the rear end of the embodiment 22 presenting a unitary ball-shaped handle configuration. The pivot pin 60 and the formed wire spring 72 are completely concealed within the hollow ball 74 providing a unique, neat appearance where the entire exposed portions of the blades are effective.

In both embodiments 20 and 22, inward squeezing palm pressure, or finger and thumb pressure, of either hand moves the blade towards closed position against the bias of the respective elastic element, namely the foam rubber-like filler 42 in FIGS. 1–9 or the spring 72 in FIGS. 10–12.

The embodiments described and shown to illustrate the present invention have been necessarily specific for purposes of illustration. Alterations, extensions, and modifications would be apparent to those skilled in the art. The aim of the appended claims, therefore, is to cover all variations included within the spirit and scope of the invention.

The embodiments of the invention in which an exclusive property or privilege is claimed are defined as follows:

1. Scissors comprising:

a pair of pivotally interconnected blades, each having a cutting edge portion at the forward end and a handle portion at the rear end;

said handle portions including outwardly convex, partially ball-shaped, manually movable members with a space therebetween;

an elastic member in said space compressibly interposed between said manually movable members biasing the blades toward an open position; and flexible means filling said space and providing with said manually movable members the general configuration of a ball which is squeezable to close the blades.

2. Scissors comprising:

a pair of pivotally interconnected blades having cutting edges at their forward end portions and a pair of transversely spaced, outwardly convex, partly ball-shaped handle members at the rear end portions of the blades respectively;

an elastic member compressibly interposed in the space between said handle members to bias said blades toward an open position; and said elastic member having an outer surface complementing said outwardly convex, partly ball-shaped handle members to provide therewith handle means having the general external configuration of a single ball which is squeezable to close the blades against the bias of said elastic member.

3. Scissors according to claim 2 in which the elastic member comprises an elastomeric body having opposite outer surfaces adhered to opposite inner surfaces respectively of the handle members.

4. Scissors comprising:

a pair of pivotally interconnected blades having cutting edges at their forward end portions and a pair of transversely spaced, outwardly convex, partly ball-shaped handle members with concave inner surfaces opposite one another at the rear end portions of the blades respectively;

an elastic member compressibly interposed in the space between said handle members to bias said blades toward an open position; and said elastic member having convex outer surfaces at opposite ends which are seated respectively in said concave inner surfaces;

whereby squeezing pressure applied to the handle members closes the blades against the bias of the electric member.

5. Scissors comprising:

a pair of pivotally interconnected blades having cutting edges at their forward end portions and a pair of transversely spaced, outwardly convex, partly ball-shaped handle members at the rear end portions of the blades respectively;

said handle members having coplanar stop members with mutually engageable surfaces limiting relative movement of the blades in a closing direction;

an elastic member compressibly interposed in the space between said handle members to bias said blades toward an open position; and said elastic member having a forward-facing slot within which the stop members are recessed;

whereby squeezing pressure applied to the handle members closes the blades against the bias of the elastic member.

6. Scissors comprising:

a pair of pivotally interconnected blades having cutting edges at their forward end portions and a pair of transversely spaced, outwardly convex, partly ball-shaped members at the rear end portions of the blades respectively;

an elastic member compressibly interposed in the space between said handle members to bias said blades toward an open position; and a hollow, flexible ball covering said partly ball-shaped handle members thereby providing handle means having the general external configuration of a single manually compressible ball which is squeezable to close the blades against the bias of the elastic member.

7. Scissors according to claim 6 in which the blades have a pivotal interconnection which is concealed within the hollow flexible ball.

8. Scissors according to claim 7 in which said elastic member comprises spring means anchored to said pivotal interconnection and seated against opposite inner surfaces of the handle members.

* * * * *